US009633639B2

(12) United States Patent
Lee

(10) Patent No.: US 9,633,639 B2
(45) Date of Patent: Apr. 25, 2017

(54) GUITAR EFFECTOR MODULE, AND MULTI-TYPE GUITAR EFFECTOR USING SAME

(71) Applicant: Seung Jae Lee, Seoul (KR)

(72) Inventor: Seung Jae Lee, Seoul (KR)

(73) Assignee: Seung Jae Lee, Seoul (KR)

( * ) Notice: Subject to any disclaimer, the term of this patent is extended or adjusted under 35 U.S.C. 154(b) by 40 days.

(21) Appl. No.: 14/442,516

(22) PCT Filed: Nov. 5, 2013

(86) PCT No.: PCT/KR2013/009969
§ 371 (c)(1),
(2) Date: May 13, 2015

(87) PCT Pub. No.: WO2014/077537
PCT Pub. Date: May 22, 2014

(65) Prior Publication Data

US 2016/0275928 A1 Sep. 22, 2016

(30) Foreign Application Priority Data

Nov. 15, 2012 (KR) ..... 10-2012-0129294

(51) Int. Cl.
*G10H 1/02* (2006.01)
*G10H 1/34* (2006.01)
(Continued)

(52) U.S. Cl.
CPC ..... *G10H 1/348* (2013.01); *G10H 1/0091* (2013.01); *G10H 1/043* (2013.01); *G10H 3/186* (2013.01); *G10H 2210/155* (2013.01)

(58) Field of Classification Search
CPC G10H 1/342; G10H 1/34; G10H 1/32; G10H 3/18; G10H 3/187; G10H 2210/141;
(Continued)

(56) References Cited

U.S. PATENT DOCUMENTS 7,786,371 B1 * 8/2010 Moates ..... G10H 1/0066 84/464 R
8,450,589 B2 * 5/2013 Nakanishi ..... G10H 1/0066 84/602
(Continued)

FOREIGN PATENT DOCUMENTS

JP 2006030841 2/2006
KR 2019980030240 8/1998
(Continued)

OTHER PUBLICATIONS

International Search Report—PCT/KR2013/009969 dated Feb. 4, 2014.

*Primary Examiner* — Marlon Fletcher
(74) *Attorney, Agent, or Firm* — Cantor Colburn LLP

(57) ABSTRACT

A guitar effector module includes: a component circuit board in which an analog guitar effector circuit is formed; a module case in which a knob for adjusting a sound by a circuit is mounted, and the component circuit board is installed therein; and a circuit connection unit, in which a circuit input unit, a circuit output unit, and a circuit power supply unit with respect to the circuit are formed, which is electrically connected with the component circuit board, and is installed on an external side of the module case.

8 Claims, 8 Drawing Sheets

(51) Int. Cl.
*G10H 1/00* (2006.01)
*G10H 1/043* (2006.01)
*G10H 3/18* (2006.01)

(58) Field of Classification Search
CPC ..... G10H 2210/311; G10H 1/46; G10H 2210/211; G10H 2210/225; G10H 2210/231; G10H 2240/056; G10H 2240/075; G10H 2240/131; G06F 3/162; H03F 3/68; H03G 5/025; H04S 2400/13
See application file for complete search history.

(56) References Cited

U.S. PATENT DOCUMENTS

| | | | | |
|---|---|---|---|---|
| 2006/0156903 | A1* | 7/2006 | Baird | G10H 1/348 84/453 |
| 2007/0234880 | A1* | 10/2007 | Adams | G10H 1/0066 84/601 |
| 2009/0229449 | A1* | 9/2009 | Yamada | G10H 1/348 84/612 |
| 2013/0298752 | A1* | 11/2013 | Juszkiewicz | G10H 1/34 84/746 |
| 2013/0327201 | A1* | 12/2013 | Urry | G10H 1/06 84/626 |
| 2015/0161978 | A1* | 6/2015 | Packouz | G10H 1/40 84/746 |

FOREIGN PATENT DOCUMENTS

| | | |
|---|---|---|
| KR | 1020020014710 | 2/2002 |
| KR | 1020030005827 | 1/2003 |
| KR | 1020110107516 | 10/2011 |

* cited by examiner

GUITAR EFFECTOR MODULE, AND MULTI-TYPE GUITAR EFFECTOR USING SAME

TECHNICAL FIELD

The present invention relates to a musical instrument, and particularly, to a guitar effector.

BACKGROUND ART

Various types of effector are used for modulating a tone of an electronic guitar.

The effector may be divided according to an analog type and a digital type, and the latter type has an advantage in convenient use, but has a disadvantage in a poor sound quality, so that recently, the effector in the analog type has been mainly used again.

The effector in the analog type is called a compactor, and is also called "kukkuki" because a performer adjusts on and off of the effector through a foot switch during performance.

In general, a plurality of compactors is connected for use, and in this case, when all of the plurality of compactors are turned on, it is possible to obtain a modulated tone by a combination of the plurality of compactors, and when some of the compactors are turned on and some of the compactors are turned off, the turned-off compactors bypass and a modulated tune is obtained by a combination of only the turned-on compactors.

A performer generally uses a plurality of tones within the same music while playing a guitar, and one tone among the tones is used by a combination of the plurality of compactors.

For example, for arpeggio or stroke, the effectors, such as chorus, delay, reverbe, are combined and used in order to obtain a clean tone, for backing for providing a lock music feeling, the effectors, such as distortion, over drive, and heavy metal, are combined and used, and when a special effect is required, the effectors, such as flanger and phaser, are combined and used.

In the meantime, it is very difficult for a performer to make the combination by manipulating the plurality of foot switches during performance, so that a multi-type device (loop) of a guitar effector for previously setting a combination of compactors has been developed (FIG. 1).

The multi-type device is related to a guitar effector for modulating an input signal of a guitar 1 and outputting the modulated input signal to an amplifier 2, and is configured so that a plurality of compactors 10 is combined with each other and connected to a device main body 20 by a send 24 manner and a return 25 manner, and the plurality of compactors 10 is turned on or off by one foot switch 23.

However, the multi-type device has the following problems.

First, the large number of cables is required in order to connect a plurality of compactors, and thus it is inconvenient to install and use the multi-type device, and costs are increased.

Second, each of the plurality of compactors and the main body of the multi-type device is a complete product, so that volume of the plurality of compactors and the multi-type device is excessively large, unnecessary weight is large, and it is inconvenient to transport and store the plurality of compactors and the multi-type device.

DISCLOSURE

Technical Problem

The present invention has been made in an effort to solve the above-mentioned problems, and provides a guitar effector module and a multi-type guitar effector using the same, which do not require use of cables even while using a plurality of analog effector circuits, so that it is convenient to transport, store, install, and use the guitar effector module, and costs may be reduced, which have a shielding effect protecting a signal of an analog circuit from external noises, and which are capable of preventing a circuit board from being damaged due to carelessness during an exchange of a module.

Technical Solution

In accordance with an aspect of the present invention, there is provided a guitar effector module 100, including: a component circuit board 110 in which an analog guitar effector circuit is formed; a module case 130 in which a knob 131 for adjusting a sound by a circuit is mounted, and the component circuit board 110 is installed therein; and a circuit connection unit 120, in which a circuit input unit 121, a circuit output unit 122, and a circuit power supply unit 123 with respect to the circuit are formed, which is electrically connected with the component circuit board 110, and is installed on an external side of the module case 130.

A signal ground connection unit 124 is formed in the circuit connection unit 120.

The guitar effector module 100 may further include a latching part 150 formed in the module case 130 while protruding from an upper side of the module case 130 to an outer side, and stepped in an upper direction.

In accordance with another aspect of the present invention, there is provided a multi-type guitar effector, in which the plurality of guitar effector modules 100 is installed, including: a main body 210 provided with a module mounting space 211 for mounting the plurality of guitar effector modules 100 therein; a plurality of opening parts 212, which is formed on an upper surface of the main body 210 in a shape corresponding to one or more module cases 130, so that the plurality of module cases 130 is installed; a plurality of main body connection units 220, in which main body input units 221, main body output units 222, and main body power supply units 223 are formed so as to be correspondingly connected to the circuit input units 121, the circuit output units 122, and the circuit power supply units 123 of the plurality of circuit connection units 120; a main body circuit board 230, which is connected with the plurality of main body connection units 220 and mounted in a main body circuit mounting space 213 of the main body 210, and in which a main body circuit is formed; an input terminal 201, which is formed in the main body 210 so as to receive an input signal of a guitar 1 and connected to the main body circuit; an output terminal 202, which is formed in the main body 210 so as to transmit an output signal to an amplifier 2 and connected to the main body circuit; and a plurality of switches 240, which is installed in the main body 210 so as to turn on and off the component circuit board 110 and connected to the main body circuit, in which the main body circuit makes a control so that an input signal received through the input terminal 201 is modulated while sequentially passing through the plurality of component circuits, and the modulated signal is output through the output terminal 202.

the main body circuit may make a control so that an input signal received through the input terminal 201 is transmitted to the circuit input units 121 of the plurality of circuit connection units 120 through the main body output units 222 of the plurality of main body connection units 220, and the signals modulated by the plurality of component circuits are received by the main body input units 221 of the plurality of main body connection units 220 through the circuit output units 122 of the plurality of circuit connection units 120 and output through the output terminal 202.

One switch 240 may be installed so as to turn on or off the plurality of component circuit boards 110.

The main body circuit may have a programmable loop function.

A power supply terminal 203 may be installed in the main body 210, and the main body circuit may supply power supplied from the power supply terminal 203 to the plurality of component circuit boards 110 through the main body power supply units 223 of the plurality of main body connection units 220 and the circuit power supply units 123 of the plurality of circuit connection units 120.

The module mounting space 211 and the main body circuit mounting space 213 of the main body 210 may be spatially divided by a partition wall 214, and the plurality of circuit connection units 120 and the plurality of main body connection units 220 may be coupled in the module mounting space 211.

In accordance with another aspect of the present invention, there is provided a multi-type guitar effector, in which the plurality of guitar effector modules 100 is installed, including: a main body 210 provided with a module mounting space 211 for mounting the plurality of guitar effector modules 100 therein; a plurality of opening parts 212, which is formed on an upper surface of the main body 210 in a shape corresponding to one or more module cases 130, so that the plurality of module cases 130 is installed; a plurality of main body connection units 220, in which main body input units 221, main body output units 222, main body power supply units 223, and signal ground connection units 224 are formed so as to be correspondingly connected to the circuit input units 121, the circuit output units 122, the circuit power supply units 123, and the signal ground connection units 124 of the plurality of circuit connection units 120; a main body circuit board 230, which is connected with the plurality of main body connection units 220 and mounted in a main body circuit mounting space 213 of the main body 210, and in which a main body circuit is formed; an input terminal 201, which is formed in the main body 210 so as to receive an input signal of a guitar 1 and connected to the main body circuit; an output terminal 202, which is formed in the main body 210 so as to transmit an output signal to an amplifier 2 and connected to the main body circuit; and a plurality of switches 240, which is installed in the main body 210 so as to turn on and off the component circuit board 110 and connected to the main body circuit, in which the main body circuit makes a control so that an input signal received through the input terminal 201 is modulated while sequentially passing through the plurality of component circuits, and the modulated signal is output through the output terminal 202.

In accordance with another aspect of the present invention, there is provided a multi-type guitar effector, in which the plurality of guitar effector modules 100 is installed, including: a main body 210 provided with a module mounting space 211 for mounting the plurality of guitar effector modules 100 therein; a plurality of opening parts 212, which is formed on an upper surface of the main body 210 in a shape corresponding to one or more module cases 130, so that the plurality of module cases 130 is installed and the latching part s150 are caught; a plurality of main body connection units 220, in which main body input units 221, main body output units 222, and main body power supply units 223 are formed so as to be correspondingly connected to the circuit input units 121, the circuit output units 122, and the circuit power supply units 123 of the plurality of circuit connection units 120; a main body circuit board 230, which is connected with the plurality of main body connection units 220 and mounted in a main body circuit mounting space 213 of the main body 210, and in which a main body circuit is formed; an input terminal 201, which is formed in the main body 210 so as to receive an input signal of a guitar 1 and connected to the main body circuit; an output terminal 202, which is formed in the main body 210 so as to transmit an output signal to an amplifier 2 and connected to the main body circuit; and a plurality of switches 240, which is installed in the main body 210 so as to turn on and off the component circuit board 110 and connected to the main body circuit, in which the main body circuit makes a control so that an input signal received through the input terminal 201 is modulated while sequentially passing through the plurality of component circuits, and the modulated signal is output through the output terminal 202.

In accordance with another aspect of the present invention, there is provided a switch module 300 coupled with the guitar effector module 100 in order to form a compactor-type guitar effector, including: a main body case 310 provided with an accommodation space therein; a main body connection unit 320, in which a main body input unit 321, a main body output unit 322, and a main body power supply unit 323 are formed so as to be correspondingly connected to the circuit input unit 121, the circuit output unit 122, and circuit power supply unit 123 of the circuit connection unit 120, and which is installed on an external side of the main body case 310; a main body circuit board 330, which is connected to the main body connection unit 320, mounted inside the main body case 310, and in which a main body circuit is formed; an input terminal 301, which is formed in the main body case 310 so as to receive an input signal of a guitar 1 and connected to the main body circuit; an output terminal 302, which is formed in the main body case 310 so as to transmit an output signal to an amplifier 2 and connected to the main body circuit; and a switch 340, which is installed in the main body case 310 so as to turn on or off the component circuit board 110 and connected to the main body circuit, in which the main body circuit makes a control so that an input signal received through the input terminal 301 is modulated by the component circuit, and the modulated signal is output through the output terminal 302.

In accordance with another aspect of the present invention, there is provided a switch module 300 coupled with the guitar effector module 100 in order to form a compactor-type guitar effector, including: a main body case 310 provided with an accommodation space therein; a main body connection unit 320, in which a main body input unit 321, a main body output unit 322, a main body power supply unit 323, and a signal ground connection unit 324 are formed so as to be correspondingly connected to the circuit input unit 121, the circuit output unit 122, the circuit power supply unit 123, and the signal ground connection unit 124 of the circuit connection unit 120, and which is installed on an external side of the main body case 310; a main body circuit board 330, which is connected to the main body connection unit 320, mounted inside the main body case 310, and in which a main body circuit is formed; an input terminal 301, which is formed in the main body case 310 so as to receive an input signal of a guitar 1 and connected to the main body circuit; an output terminal 302, which is formed in the main body case 310 so as to transmit an output signal to an amplifier 2 and connected to the main body circuit; and a switch 340, which is installed in the main body case 310 so as to turn on or off the component circuit board 110 and connected to the main body circuit, in which the main body circuit makes a control so that an input signal received through the input terminal 301 is modulated by the component circuit, and the modulated signal is output through the output terminal 302.

In accordance with another aspect of the present invention, there is provided a switch module 300 coupled with the guitar effector module 100 in order to form a compactor-type guitar effector, including: a main body case 310, in which an accommodation space is formed therein, and which is formed so that the latching part 150 is caught by an edge thereof; a main body connection unit 320, in which a main body input unit 321, a main body output unit 322, and a main body power supply unit 323 are formed so as to be correspondingly connected to the circuit input unit 121, the circuit output unit 122, and circuit power supply unit 123 of the circuit connection unit 120, and which is installed on an external side of the main body case 310; a main body circuit board 330, which is connected to the main body connection unit 320, mounted inside the main body case 310, and in which a main body circuit is formed; an input terminal 301, which is formed in the main body case 310 so as to receive an input signal of a guitar 1 and connected to the main body circuit; an output terminal 302, which is formed in the main body case 310 so as to transmit an output signal to an amplifier 2 and connected to the main body circuit; and a switch 340, which is installed in the main body case 310 so as to turn on or off the component circuit board 110 and connected to the main body circuit, in which the main body circuit makes a control so that an input signal received through the input terminal 301 is modulated by the component circuit, and the modulated signal is output through the output terminal 302.

In accordance with an aspect of the present invention, there is provided a compactor-type guitar effector, including: a guitar effector module 100 which includes: a component circuit board 110 in which an analog guitar effector circuit is formed; a module case 130 in which a knob 131 for adjusting a sound by a circuit is mounted, and the component circuit board 110 is installed therein; and a circuit connection unit 120, in which a circuit input unit 121, a circuit output unit 122, and a circuit power supply unit 123 with respect to the circuit are formed, which is electrically connected with the component circuit board 110, and is installed on an external side of the module case 130; the switch module 300; and a coupling plate 400 commonly coupled to lower surfaces or lateral surfaces of the guitar effector module 100 and the switch module 300.

In accordance with an aspect of the present invention, there is provided a compactor-type guitar effector, including: a guitar effector module 100 which includes: a component circuit board 110 in which an analog guitar effector circuit is formed; a module case 130 in which a knob 131 for adjusting a sound by a circuit is mounted, a latching part 150 is formed while protruding from an upper side of the module case 130 to an outer side, and stepped in an upper direction, and the component circuit board 110 is installed therein; and a circuit connection unit 120, in which a circuit input unit 121, a circuit output unit 122, and a circuit power supply unit 123 with respect to the circuit are formed, which is electrically connected with the component circuit board 110, and is installed on an external side of the module case 130; the switch module 300; and a coupling plate 400 commonly coupled to lower surfaces of the guitar effector module 100 and the switch module 300.

The coupling plate 400 may be formed in a structure corresponding to the plurality of guitar effector modules 100 and one switch module 300.

Advantageous Effects

The present invention suggests the guitar effector module and the multi-type guitar effector using the same, which do not require use of cables while using a plurality of analog effector circuits, so that it is convenient to transport, store, install, and use the guitar effector module, and costs may be reduced, which have a shielding effect protecting a signal of an analog circuit from external noises, and which are capable of preventing a circuit board from being damaged due to carelessness during an exchange of a module.

DESCRIPTION OF DRAWINGS

FIG. 2 is a perspective view of a first exemplary embodiment of a guitar effector module.

FIG. 3 is a perspective view of a second exemplary embodiment of a guitar effector module.

FIG. 4 is a top plan view of a multi-type guitar effector according to a first exemplary embodiment and a second exemplary embodiment.

FIG. 5 is a perspective view of the multi-type guitar effector according to the first exemplary embodiment and the second exemplary embodiment.

FIG. 6 is a top plan view of a connection unit between the guitar effector module and a main body of the multi-type guitar effector.

FIG. 7 is a cross-sectional view of the multi-type guitar effector according to the first exemplary embodiment and the second exemplary embodiment.

FIG. 8 is an exploded perspective view of a first exemplary embodiment of a compact-type guitar effector.

FIG. 9 is an exploded perspective view of a second exemplary embodiment of a compact-type guitar effector.

FIG. 10 is a cross-sectional view of the first exemplary embodiment of the compact-type guitar effector.

FIG. 11 is a top plan view of a connection unit between the guitar effector module and a switch module of the compact-type guitar effector.

EXPLANATION OF REFERENCE NUMERALS AND SYMBOLS

Figure 1:
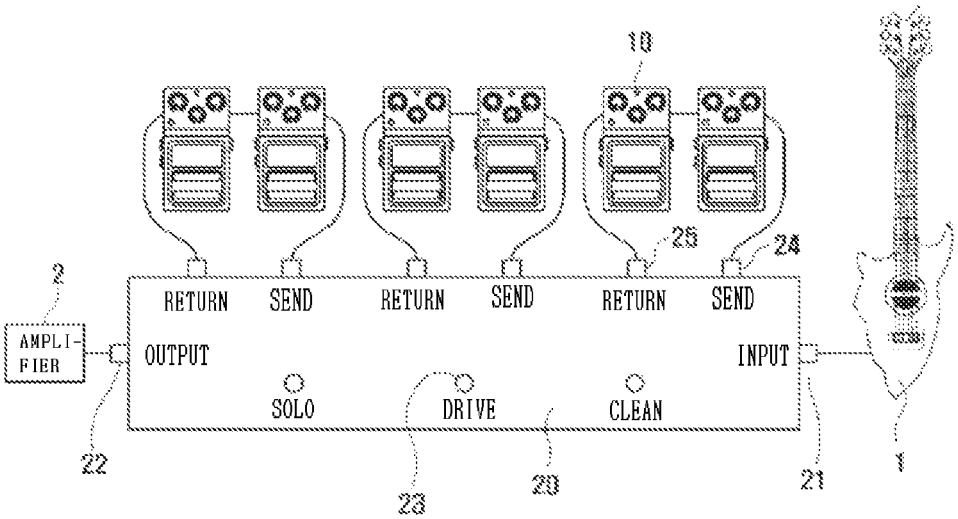
FIG. 1 PRIOR ART
FIG. 1 is a configuration diagram illustrating a multi-type guitar effector in the related art.
Figure 2:
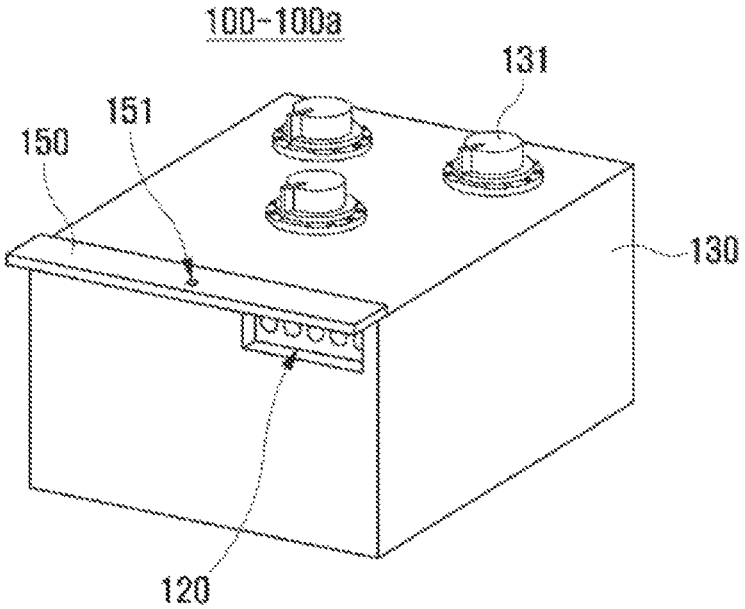
FIGS. 2 to 11 illustrate exemplary embodiments of the present invention.

100: Guitar effector module
110: Component circuit board
120: Circuit connection unit
121: Circuit input unit
122: Circuit output unit
123: Circuit power supply unit
130: Module case 131: Knob
201: Input terminal 202: Output terminal
203: Power supply terminal 210: Main body
211: Module mounting space 212: Opening part
213: Main body circuit mounting space
214: Partition wall

220: Main body connection unit
221: Main body input unit
222: Main body output unit
223: Main body power supply unit
230: Main body circuit board 240: Switch
300: Switch module 400: Coupling plate

BEST MODE

Mode for Invention

Hereinafter, exemplary embodiments of the present invention will be described in detail with reference to the accompanying drawings.

As illustrated in FIGS. 2 to 11, a guitar effector module 100 according to the present invention basically includes: a component circuit board 110 in which an analog guitar effector circuit is formed; a module case 130 in which a knob 131 for adjusting a sound by a circuit is mounted, and the component circuit board 110 is installed therein; and a circuit connection unit 120 in which a circuit input unit 121, a circuit output unit 122, and a circuit power supply unit 123 with respect to the circuit are formed, which is electrically connected with the component circuit board 110, and is installed on an external side of the module case 130.

Figure 4:
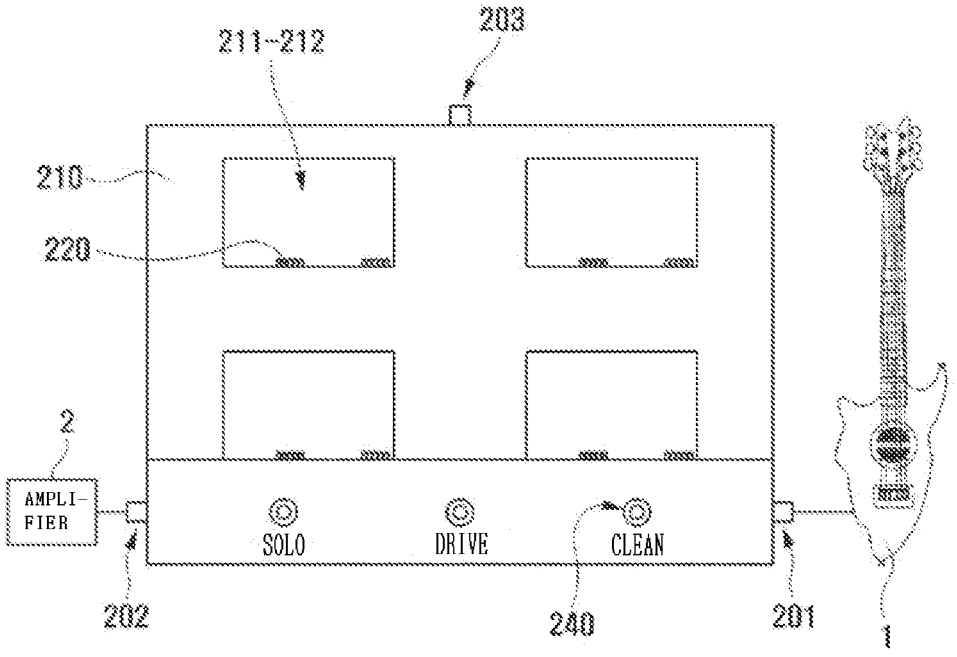
Figure 5:
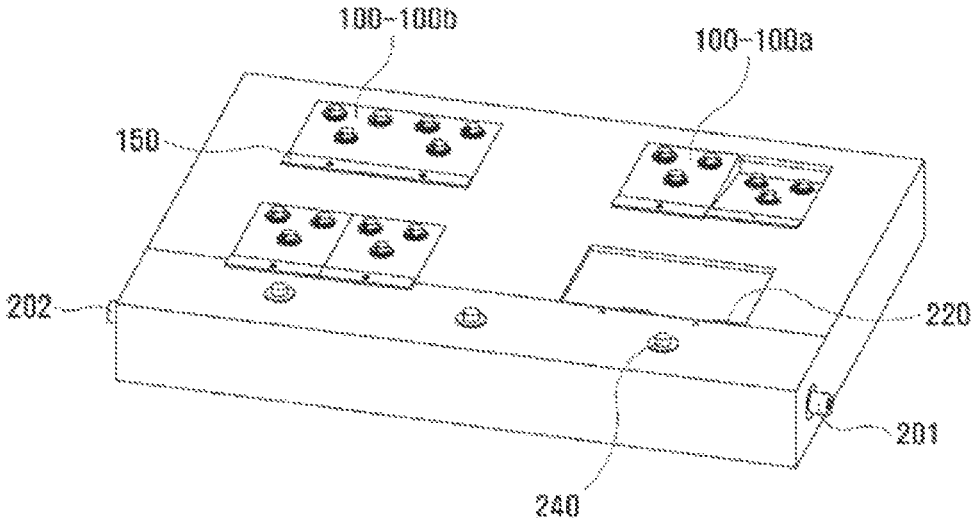
Figure 6:
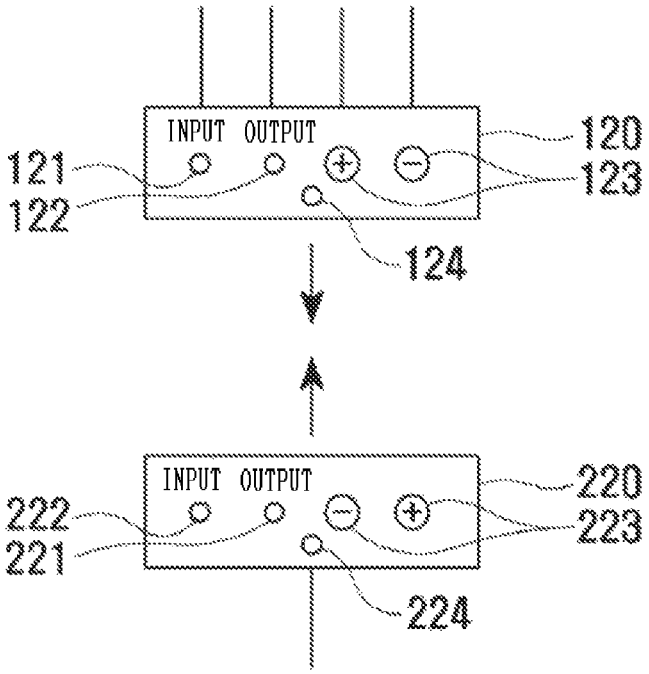

A multi-type guitar effector, in which the plurality of guitar effector modules 100 is installed, basically includes: a main body 210 provided with a module mounting space 211 for mounting the plurality of guitar effector modules 100 therein; a plurality of opening parts 212 formed on an upper surface of the main body 210 in a shape corresponding to one or more module cases 130, so that the plurality of module cases 130 is installed; a plurality of main body connection units 220, in which main body input units 221, main body output units 222, and main body power supply units 223 are formed so as to be correspondingly connected to the circuit input units 121, the circuit output units 122, and the circuit power supply units 123 of the plurality of circuit connection units 120; a main body circuit board 230, which is connected with the plurality of main body connection units 220 and mounted in a main body circuit mounting space 213 of the main body 210, and in which a main body circuit is formed; an input terminal 201, which is formed in the main body 210 so as to receive an input signal of a guitar 1 and connected to the main body circuit; an output terminal 202 formed in the main body 210 so as to transmit an output signal to an amplifier 2 and connected to the main body circuit; and a plurality of switches 240, which is installed in the main body 210 so as to turn on and off the component circuit board 110 and connected to the main body circuit (FIGS. 4 and 5).

Here, the main body circuit makes a control so that an input signal received through the input terminal 201 is modulated while sequentially passing through the plurality of component circuits, and the modulated signal is output through the output terminal 202.

Particularly, the main body circuit makes a control so that an input signal received through the input terminal 201 is transmitted to the circuit input units 121 of the plurality of circuit connection units 120 through the main body output units 222 of the plurality of main body connection units 220, and the signals modulated by the plurality of component circuits are received by the main body input units 221 of the plurality of main body connection units 220 through the circuit output units 122 of the plurality of circuit connection units 120 and output through the output terminal 202.

In order to reduce noises, a signal ground (signal GND) may be separately connected, so that a signal ground connection unit 124 of the circuit connection unit 120 is separately connected with a signal ground connection unit 224 of the main body connection unit 220.

For example, the input signal received through the input terminal 201 is transmitted to the circuit input unit 121 of the circuit connection unit 120 of the first guitar effector module 100 through the main body output unit 222 of the first main body connection unit 220 of the main body 210, and a signal modulated by the circuit of the first guitar effector module 100 is transmitted to the main body input unit 221 of the first main body connection unit 220 through the circuit output unit 122 of the circuit connection unit 120 and is transmitted to the main body circuit again.

The signal of the main body circuit is transmitted to the circuit input unit 121 of the circuit connection unit 120 of the second guitar effector module 100 through the main body output unit 222 of the second main body connection unit 220 of the main body 210, and a signal modulated by the circuit of the second guitar effector module 100 is transmitted to the main body input unit 221 of the second main body connection unit 220 through the circuit output unit 122 of the circuit connection unit 120 and is transmitted to the main body circuit again.

Through the aforementioned process, the signal modulated by the circuit of the last guitar effector module 100 is transmitted to the main body input unit 221 of the last main body connection unit 220 through the circuit output unit 122 of the circuit connection unit 120, and is output through the output terminal 202.

That is, the multi-type guitar effector according to the present invention is not configured by a plurality of compactors and a multi-type device, which are the separate complete products, similar to the prior art, but is configured, so that the plurality of guitar effector modules 100 is combined with the main body 210 of the multi-type guitar effector to form a complete product.

When the multi-type guitar effector includes the aforementioned configuration, a plurality of guitar effector circuits may have a mutually combined structure only by mounting the guitar effector modules 100 inside the main body 210 and connecting the circuit connection units 120 to the main body connection units 220 of the main body, so that it is possible to omit use of a plurality of cables, which is used in the related art, and thus it is convenient to transport, store, install, and use the multi-type guitar effector.

The knob 131 for adjusting volume, a tone, and the like, is mounted in the module case 130, and the module case 130 is coupled to the opening part 212 of the main body, so that it is possible to adjust an effector circuit of a corresponding component assembly by the knob 131.

Figure 7:
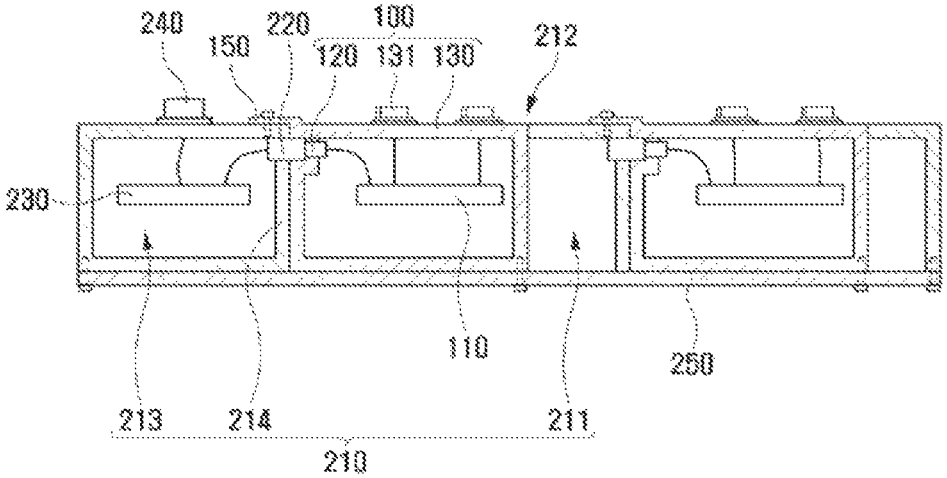

A latching part 150 is formed in the module case 130 while protruding from an upper side of the module case 130 to an external side and stepped in an upper direction, and when an upper surface of the guitar effector module 100 having the aforementioned structure is exposed through the opening part 212 through an opening part at a lower side of the main body 210, the latching part 150 is caught by an edge of the opening part 212 of the main body, and the lower opening part of the main body 210 is coupled (screw-engaged) to a separate closing plate 250, it is possible to conveniently and stably couple the guitar effector module 100 and the main body 210 (FIG. 7).

When a coupling hole 151 is formed in the latching part 150, and a screw member and the like is coupled to the main body 210 through the coupling hole 151, it is possible to more stably couple the guitar effector module 100 and the main body 210.

Figure 3:
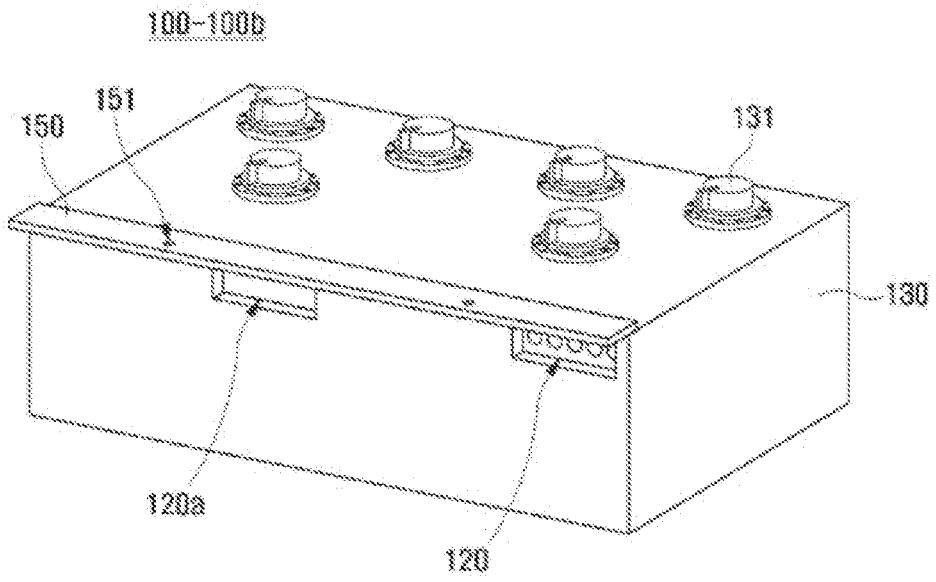

The opening part 212 of the main body 210 is formed in a shape corresponding to one or more module cases 130 (FIG. 4), and when the opening part 212 is formed in a shape corresponding to the plurality of module cases 130, a plurality of small guitar effector modules 100*a* may be installed in one opening part 212 (FIG. 2), and a large guitar effector module 100*b* having a size of two or three times of the small guitar effector module may be installed (FIG. 3).

In the above description, the guitar effector module 100*b* means a case where a large substrate is required, similar to a vacuum tube circuit.

The configuration that the main body connection unit 220 of the main body of the multi-type guitar effector protrudes from a lower side of the opening part 212, and the circuit connection unit 120 of the guitar effector module 100 is recessed so as to correspond to the main body connection unit 220 is preferable to stably mount the guitar effector module 100 (FIGS. 2 to 5).

In the configuration that the plurality of small guitar effector modules 100*a* or one large guitar effector module 100*b* is installable in one opening part 212 (FIG. 4), the plurality of main body connection units 220 is positioned in one opening part 212.

In this case, the case where the plurality of small guitar effector modules 100*a* is installed is not related, but when the large guitar effector module 100*b* is installed, a conflict is generated between some of the plurality of main body connection units 220 and the module case 130 of the large guitar effector module 100*b*.

In order to prevent the conflict, a recess portion 120*a* having a similar configuration to that of the circuit connection unit 120 is formed in the module case 130 of the large guitar effector module 100*b*, separately from the circuit connection unit 120, so that the conflicted main body connection unit 220 may be inserted into the recess portion 120*a* (FIG. 3).

In order to stably obtain the aforementioned advantage, the large guitar effector module 100*b* may be manufactured to have a size corresponding to several times (two times, three times) of a size of the small guitar effector module 100*a*.

The circuit input unit 121 for transmitting an input signal to the circuit, the circuit output unit 122 for outputting an output signal modified by the circuit, and the circuit power supply unit 123 for supplying power to the circuit are formed in the circuit connection unit 120 of the guitar effector module 100.

The main body input unit 221 for receiving the output signal of the circuit output unit 122, the main body output unit 222 for transmitting the signal of the main body circuit to the circuit input unit 121 of the guitar effector module 100, and the main body power supply unit 223 for supplying power to the circuit power supply unit 123 are formed in the main body connection unit 220 connected to the circuit connection unit 120.

The circuit connection unit 120 of the guitar effector module 100 is coupled with the main body connection unit 220 of the main body 210 by fit-coupling by a concave-convex structure, and when the upper surface of the guitar effector module 100 has a coupling structure exposed through the opening part 212 as described above, the circuit connection unit 120 of the guitar effector module 100 has a recess structure and the main body connection unit 220 of the main body 210 has a protruding structure, so that the guitar effector module 100 is coupled to the main body 210 and the circuit connection unit 120 is naturally coupled with the main body connection unit 220.

The main body 210 is spatially divided by a partition wall 214, and the main body circuit board 230 is mounted in the main body circuit mounting space 213 among the divided spaces, and the guitar effector module 100 is mounted in the module mounting space 211 at an opposite side of the main body circuit mounting space 213.

The main body connection unit 220 connected to the main body circuit board 230 is exposed toward the module mounting space 211 over the partition wall 214, and the plurality of guitar effector modules 100*a* is coupled in the module mounting space 211.

Accordingly, a user may configure the multi-type guitar effector having a desired coupling by coupling the plurality of guitar effector modules 100 to the main body 210 in a desired pattern so that the circuit connection unit 120 is coupled to the main body connection unit 220 in the module mounting space 211 inside the main body 210.

The input terminal 201 connected to the main body circuit for receiving an input signal of the guitar 1 and the output terminal 202 connected to the main body circuit for transmitting an output signal to the amplifier 2 are formed at one side or both sides of the main body 210, and the plurality of switches 240 connected to the main body circuit for turning on or off the component circuit board 110 is installed so as to be exposed on the upper surface of the main body 210.

Here, it is preferable that one switch 240 is installed to turn on or off the plurality of component circuit board 110 for use convenience.

The plurality of switches 240 including the aforementioned configuration is installed, and when all of the switches are turned on, a tone is modified by the circuits of all of the component circuit boards 110, and when some switches are turned on and some switches are turned off, the turned-off circuits bypass and a tone is modified only by the turned-on circuits.

The power supply terminal 203 is installed in the main body 210, and power supplied to the power supply terminal 203 is supplied to the plurality of component circuit boards 110 through the main body power supply units 223 of the plurality of main body connection units 220 and the circuit power supply units 123 of the plurality of circuit connection units 120.

The main body circuit serves to output a signal input through one of the plurality of main body connection units 220 through the next main body connection unit 220, and output a modified signal to the output terminal through the repetition of the process as described above.

In the above, it has been the exemplary embodiment that the component circuit board 110 of one guitar effector module 110 is turned on and off by one switch 240, but the main body circuit of the main body circuit board 230 may also be formed so that the component circuit board 110 of one guitar effector module 100 is turned on and off by the plurality of switches 240 (a programmable loop function).

For example, the main body circuit may be formed so that one chorus effector circuit is operated by a clean tone switch, and is operated by a solo tone switch.

The guitar effector module 100 according to the present invention may be combined with a compactor-type guitar effector, as well as the aforementioned multi-type guitar effector, and used.

In this case, the compactor-type guitar effector is formed by the coupling of the guitar effector module 110 and a separate switch module 300.

Figure 8:
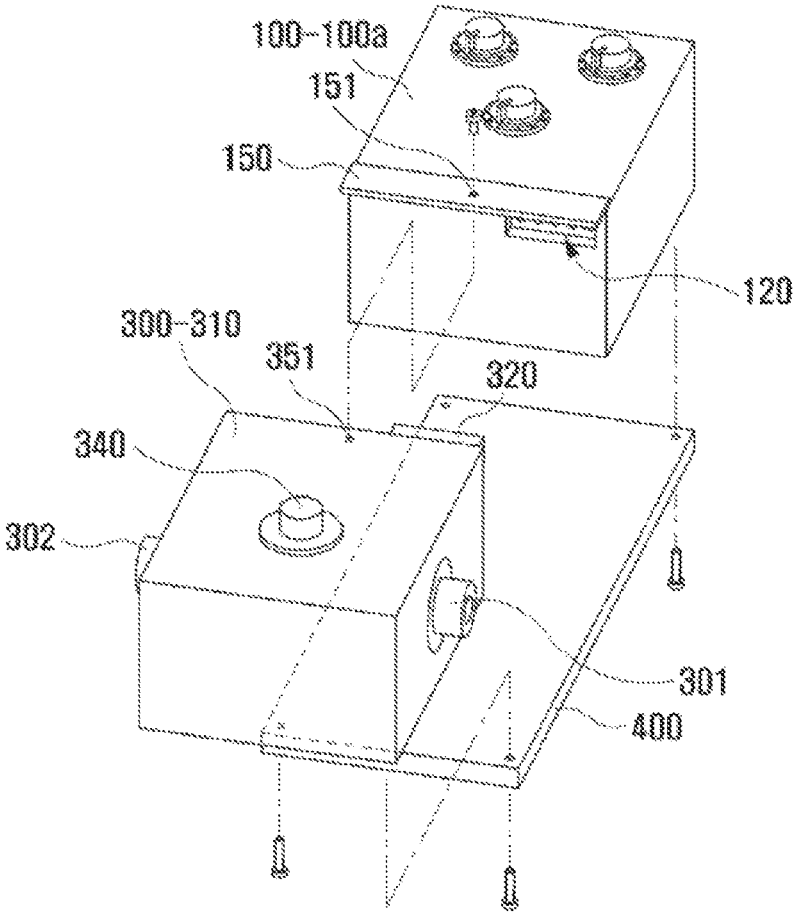
Figure 9:
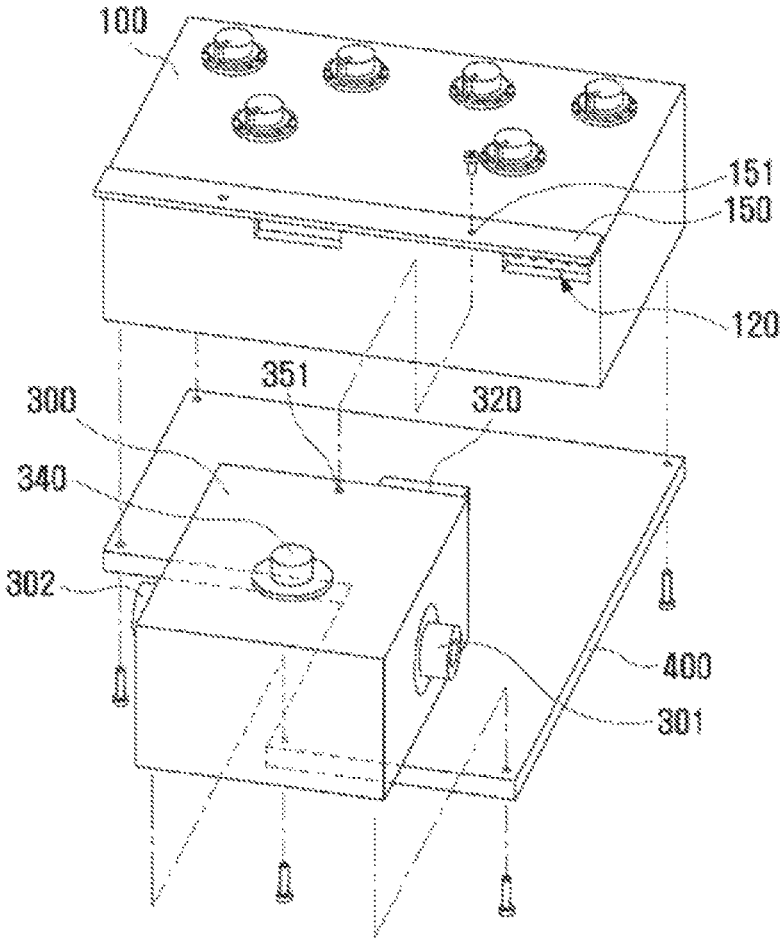
Figure 10:
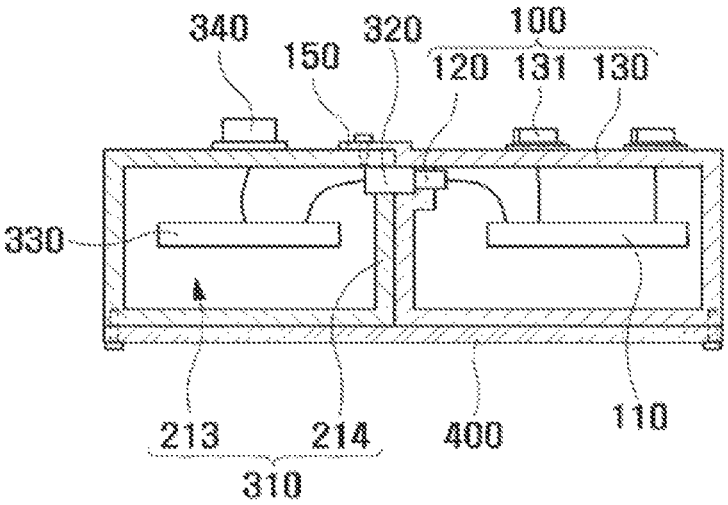
Figure 11:
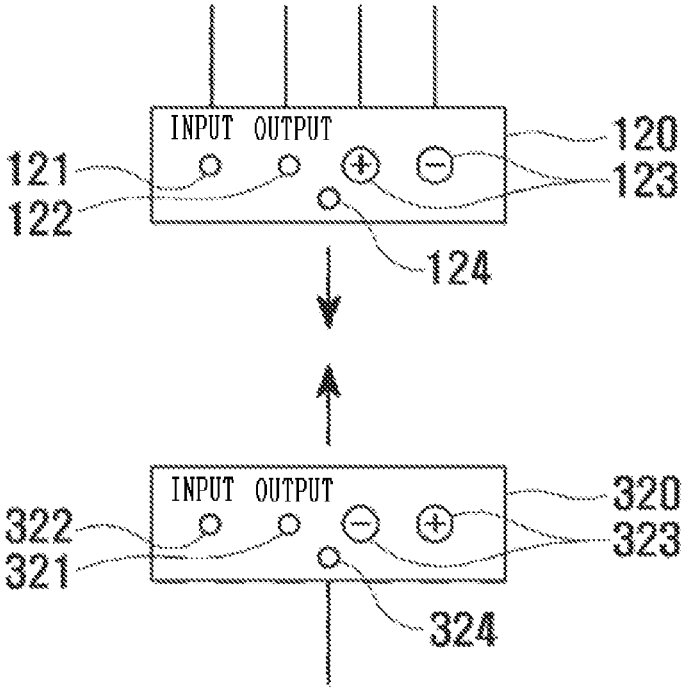

Here, the switch module 300 includes: a main body case 310 provided with an accommodation space therein; a main body connection unit 320, in which a main body input unit 321, a main body output unit 322, and a main body power supply unit 323 are formed so as to be correspondingly connected to the circuit input unit 121, the circuit output unit 122, and the circuit power supply unit 123 of the circuit connection unit 120, and which is installed on an external side of the main body case 310; a main body circuit board 330, which is connected to the main body connection unit 320, mounted inside the main body case 310, and in which a main body circuit is formed; an input terminal 301 formed in the main body case 310 so as to receive an input signal of the guitar 1 and connected to the main body circuit; an output terminal 302 formed in the main body case 310 so as to transmit an output signal to the amplifier 2 and connected to the main body circuit; and a switch 340 installed in the main body case 310 so as to turn on or off the component circuit board 110 and connected to the main body circuit (FIGS. 8 to 10).

The main body circuit makes a control so that an input signal received through the input terminal 301 is modulated by the component circuit, and the modulated signal is output through the output terminal 302.

This has the same operational effect as that of the multi-type guitar effector, except for the fact that the modulation signal is implemented by one effector circuit.

Even in the present exemplary embodiment, in order to reduce noises, the signal ground (signal GND) may be separately connected, so that the signal ground connection unit 124 of the circuit connection unit 120 and a signal ground connection unit 324 are separately connected.

The coupling of the guitar effector module 100 and the switch module 300 may be implemented by various structures, and when a coupling structure (screw-engagement, and the like) by a coupling plate 400 commonly coupled to lower surfaces or lateral surfaces of the guitar effector module 100 and the switch module 300 is adopted, there is an effect in that coupling work is simple and it is possible to obtain excellent structural stability.

When the coupling plate 400 is coupled to the lower surfaces of the guitar effector module 100 and the switch module 300 in a state where the latching part 150 formed in the module case 130 of the guitar effector module 100 is caught by the main body case 310 of the switch module 300, it is possible to obtain a more stably structure (FIG. 8)

When the coupling hole 151 is formed in the latching part 150, a coupling hole 351 is formed in the main body case 310, and a screw member and the like is coupled through the coupling holes, it is possible to achieve more stably coupling.

It is preferable to form the switch module 300 to have the same width as that of the general small guitar effector module 100*a* for use convenience, and in this case, the coupling plate 400 is enough to have a rectangular structure.

As described above, when the large guitar effector module 100*b* is coupled with the switch module 300, the coupling plate 400 formed in a structure corresponding to the plurality of guitar effector modules 100 (to have the same width as that of the large guitar effector module 100*b*) and one switch module 300 may be used.

To this end, the large guitar effector module 100*b* may be manufactured so as to have a size corresponding to several times (two times, three times) of the size of the small guitar effector module 100*a*, and the coupling plate 400 may have a "¬"-shaped structure and the like.

In the meantime, recently, in order to obtain a desired tone, there are many cases where a user directly designs and manufactures an analog effector circuit.

The present invention is related to a structure, by which the effector manufactured in a module form is easily coupled to the main body, so that the present invention may be greatly effectively applied to the aforementioned case.

In the above, some of the exemplary embodiments, which may be implemented by the present invention, have been described, so that as is well know, the scope of the present invention shall not be interpreted while being limited to the above exemplary embodiments, and all of the technical spirits including the common basis of the present invention are included in the scope of the present invention.

The invention claimed is:

1. A multi-type guitar effector comprising:

a plurality of guitar effector modules (100), wherein each of the guitar effector modules comprises: a component circuit board (110) in which an analog guitar effector circuit is formed; a module case (130) in which a knob (131) for adjusting a sound by a circuit is mounted, and the component circuit board (110) is installed therein; and a circuit connection unit (120), in which a circuit input unit (121), a circuit output unit (122), and a circuit power supply unit (123) with respect to the circuit are formed, which is electrically connected with the component circuit board (110), and is installed on an external side of the module case (130);

a main body (210) provided with a module mounting space (211) for mounting the plurality of guitar effector modules (100) therein;

a plurality of opening parts (212), which is formed on an upper surface of the main body (210) in a shape corresponding to one or more module cases (130), so that the plurality of module cases (130) is installed;

a plurality of main body connection units (220), in which main body input units (221), main body output units (222), and main body power supply units (223) are formed so as to be correspondingly connected to the circuit input units (121), the circuit output units (122), and the circuit power supply units (123) of the plurality of circuit connection units (120);

a main body circuit board (230), which is connected with the plurality of main body connection units (220) and mounted in a main body circuit mounting space (213) of the main body (210), and in which a main body circuit is formed;

an input terminal (201), which is formed in the main body (210) so as to receive an input signal of a guitar (1) and connected to the main body circuit;

an output terminal (202), which is formed in the main body (210) so as to transmit an output signal to an amplifier (2) and connected to the main body circuit; and a plurality of switches (240), which is installed in the main body (210) so as to turn on and off the component circuit board (110) and connected to the main body circuit, wherein the main body circuit makes a control so that an input signal received through the input terminal (201) is modulated while sequentially passing through the plurality of component circuits, and the modulated signal is output through the output terminal (202).

2. The multi-type guitar effector module of claim 1, wherein the main body circuit makes a control so that an input signal received through the input terminal (201) is transmitted to the circuit input units (121) of the plurality of circuit connection units (120) through the main body output units (222) of the plurality of main body connection units (220), and the signals modulated by the plurality of component circuits are received by the main body input units (221) of the plurality of main body connection units (220) through the circuit output units (122) of the plurality of circuit connection units (120) and output through the output terminal (202).

3. The multi-type guitar effector module of claim 2, wherein one switch (240) is installed so as to turn on or off the plurality of component circuit boards (110).

4. The multi-type guitar effector module of claim 3, wherein the main body circuit has a programmable loop function.

5. The multi-type guitar effector module of claim 2, wherein a power supply terminal (203) is installed in the main body (210), and the main body circuit supplies power supplied from the power supply terminal (203) to the plurality of component circuit boards (110) through the main body power supply units (223) of the plurality of main body connection units (220) and the circuit power supply units (123) of the plurality of circuit connection units (120).

6. The multi-type guitar effector module of claim 2, wherein the module mounting space (211) and the main body circuit mounting space (213) of the main body (210) are spatially divided by a partition wall (214), and the plurality of circuit connection units (120) and the plurality of main body connection units (220) are coupled in the module mounting space (211).

7. The multi-type guitar effector of claim 1, wherein a signal ground connection unit (124) is formed in the circuit connection unit (120).

8. The multi-type guitar effector of claim 1, further comprising: a latching part (150) formed in the module case (130) while protruding from an upper side of the module case (130) to an outer side, and stepped in an upper direction.

* * * * *